US006565398B1

(12) United States Patent
Walczak

(10) Patent No.: US 6,565,398 B1
(45) Date of Patent: May 20, 2003

(54) FLUSHING ADAPTOR FOR AN OUTBOARD MOTOR

(75) Inventor: Thomas J. Walczak, Oconomowoc, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/135,560

(22) Filed: Apr. 30, 2002

(51) Int. Cl.[7] ..... B63C 9/08
(52) U.S. Cl. ..... 440/88.56
(58) Field of Search ..... 440/88, 89

(56) References Cited

U.S. PATENT DOCUMENTS

| | | | | | |
|---|---|---|---|---|---|
| 4,065,325 | A | | 12/1977 | Maloney | 134/167 |
| 4,589,851 | A | * | 5/1986 | Karls | 440/88 |
| 5,671,906 | A | | 9/1997 | Rosen | 251/148 |
| 5,725,403 | A | | 3/1998 | Ridolfo | 440/88 |
| 5,746,629 | A | * | 5/1998 | Smith | 440/88 |
| 5,820,427 | A | | 10/1998 | Valdes | 440/88 |
| 5,934,957 | A | | 8/1999 | Sato et al. | 440/88 |
| 5,989,086 | A | * | 11/1999 | Danchik | 440/88 |

* cited by examiner

*Primary Examiner*—Stephen Avila
(74) *Attorney, Agent, or Firm*—William D. Lanyi

(57) ABSTRACT

A flushing adaptor for an outboard motor provides a conduit connected to the cooling system of the engine of the outboard motor and to a hose fitting. The conduit is provided with a length that allows it to be extended through an opening in the surface of the outboard motor and away from the surface of the outboard motor by a sufficient distance to facilitate easy connection to an external water source, such as a garden hose, at either the front area of the outboard motor or at its side. The conduit is provided with a female hose fitting that can swivel for easy connection to an external water source. A lid is provided which is attachable to both the female hose fitting of the conduit and to the opening formed through the surface of the outboard motor.

19 Claims, 3 Drawing Sheets

FLUSHING ADAPTOR FOR AN OUTBOARD MOTOR

BACKGROUND OF THE INVENTION

1. Field of the Invention

The present invention is generally related to a device which facilitates the flushing of an outboard motor cooling system with fresh water and, more particularly, to a flushing system that provides an extendible conduit that can be maneuvered to allow convenient connection to a water supply.

2. Description of the Prior Art

The cooling system of an outboard motor should periodically be flushed to remove residue from the internal passages of the cooling system particularly when used in a salt water environment. This requirement is well known and understood by those skilled in the art. Many different devices have been provided to facilitate the flushing of the engine cooling systems of outboard motors.

U.S. Pat. No. 5,934,957, which issued to Sato et al on Aug. 10, 1999, describes an outboard motor having an oil pan positioned on the underside of the engine and having an exhaust passage, a water supply passage for cooling water and a waste water passage extending down from the engine and passing near the oil pan. The exhaust passage, the water supply passage, and the waste water passage are molded as a single unit with the oil pan, and provide a simple, lightweight structure that does not result in an increase in the number of parts or assembly man hours necessary for construction. The oil pan is protected by exhaust heat by the water passages, and a flush port to clean the cooling system is easily accessible.

U.S. Pat. No. 4,065,325, which issued to Maloney on Dec. 27, 1977, describes an adaptable flush attachment for marine engines having side cooling water ports. This application discloses a device universally adaptable for use in flushing outboard and inboard/outboard marine engines; this being possible due to the unique design of the strap and the shape of the cups allowing for the device to attach flush against the motor shaft housing on motors having shaft housings of different dimensions and contours, something not accomplished by any previously known means.

U.S. Pat. No. 5,820,427, which issued to Valdes on Oct. 13, 1998, describes an outboard flushing adaptor. The adaptor assembly is designed to effectively flush outboard motors by directing the flushing water directly into plurality of water inlets normally formed in the lower gear case housing portion of the outboard motor. The adaptor assembly includes a base removably attached at an inlet end thereof to a source of water such as a water hose and including an outlet end having a conduit assembly connected in water receiving relation thereto and extending outwardly therefrom. The distal end of the conduit assembly is specifically dimensioned and configured to be inserted within one or more of the water inlets formed in the outboard motor housing and form a defined, a focused, concentrated and generally water tight seal with the water inlets so that water may be delivered directly thereto under pressure to ensure adequate distribution throughout the entire cooling system of the outboard motor while minimizing or effectively eliminating the inadvertent and concurrent introduction of air to the cooling system and or misdirection of water outside of the inlets during the flushing process.

U.S. Pat. No. 5,725,403, which issued to Ridolfo on Mar. 10, 1998, describes a marine outboard motor flush and run tank and method of flushing a marine outboard motor. A method of flushing an outboard motor using a marine outboard motor flush and run tank wherein the marine outboard motor flush and run tank comprises a flush trough member, a fluid inlet and a fluid outlet is disclosed. The method of flushing an outboard motor flushes from the coolant system of an outboard motor salt, silt and other material. An organic detergent is added to fresh water for forming a mixture which is siphoned into the coolant system for breaking down and purging the salt, silt, and other material from the coolant system.

U.S. Pat. No. 5,671,906, which issued to Rosen on Sep. 30, 1997, describes a flush valve. The invention is a flush valve for a water cooled, marine outboard engine having a flush orifice. The flush valve includes a valve body having an engine attachment end and a flush water source end. The valve body has a channel between the engine end and the source end. The engine end of the valve body can be affixed into the flush orifice of the engine. The flush valve also includes a means for obstructing a discharge flow of cooling liquid from the engine end of the hollow valve body.

U.S. patent application Ser. No. 10/062,253, which was filed by Jaszewski et al on Jan. 31, 2002 (M09564) discloses a combined tell-tale fitting with water flushing attachment. A tell-tale system is provided for an outboard motor in which the tell-tale fluid conduit is connectable to an external water source, such as a water hose, and is extendible away from the cowl of the outboard motor in order to facilitate its use during a flushing operation. When not being used in the flushing procedure, the connector of the fluid conduit is snapped into position in connection with the cowl to maintain its position when used as a tell-tale port.

The patents described above are hereby expressly incorporated by reference in the description of the present invention.

Known flushing systems for outboard motors do not provide a convenient way in which the cooling system can be flushed with fresh water from an external water supply by an operator of the associated marine vessel from within the marine vessel itself. Most flushing systems known to those skilled in the art require that the external water supply be connected to the outboard motor at a position that is not conveniently accessible to a person remaining within the marine vessel itself. In turn, most known flushing systems require that the marine vessel first be removed from the body of water in which it is operated in order to flush its cooling system. It would therefore be significantly beneficial if a flushing adaptor for an outboard motor could be provided that allows the operator of the boat to flush the cooling system without leaving the boat itself. It would also be beneficial if the outboard motor cooling system could be flushed while the marine vessel remains in the body of water in which it is operated. Also, it would be more convenient for the operator of a marine vessel if the operator is provided with the option of either remaining in the boat or not during the flushing operation and also be given the option of flushing the cooling system either when the boat remains in the body of water in which it is operated or is removed from the body of water and supported by a boat trailer or other support mechanism.

SUMMARY OF THE INVENTION

A flushing adaptor for an outboard motor, made in accordance with the preferred embodiment of the present invention, comprises a conduit having a first end and a second end. The first end is connected in fluid communication with the cooling system of the outboard motor. In also comprises a hose fitting attached to the second end of the conduit and an opening formed in an outer surface of the outboard motor. A lid, which is removably attachable to the hose fitting, is shaped to be removably attachable to the opening. A check valve is disposed in fluid communication with the conduit in order to inhibit fluid flow through the conduit in a direction from the first end of the conduit to the second end.

The preferred embodiment of the present invention further comprises a tether attached to the lid and to the conduit for maintaining the lid in a region proximate the conduit. The hose fitting is a female hose fitting in a preferred embodiment of the present invention and the lid is threaded for attachment to the hose fitting in threaded association therewith. The lid comprises two tab extensions and the opening comprises two slots, in a preferred embodiment of the present invention. The two slots are shaped to receive the two tab extensions. The lid is attachable to the opening by rotating the lid when the two tab extensions are disposed in the two slots. The opening is disposed at a front surface of the outboard motor and the conduit is shaped to have a length which is greater than the distance between the second end and the point of attachment between the first end and the cooling system of the outboard motor. In a particularly preferred embodiment of the present invention, the conduit is shaped to have a length which is greater, by a first magnitude, than the distance between the second end and the point of attachment between the first end and the cooling system of the outboard motor, wherein the first magnitude is at least equal to one half of the width of a cowl of the outboard motor. This extra length of conduit allows the operator of the marine vessel to use the present invention either while remaining in the boat or by standing at either side of the outboard motor while the boat and outboard motor are supported by a boat trailer or other support mechanism. The extra length facilitates the connection of an external water supply, such as a garden hose, to the present invention in either of these positions.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
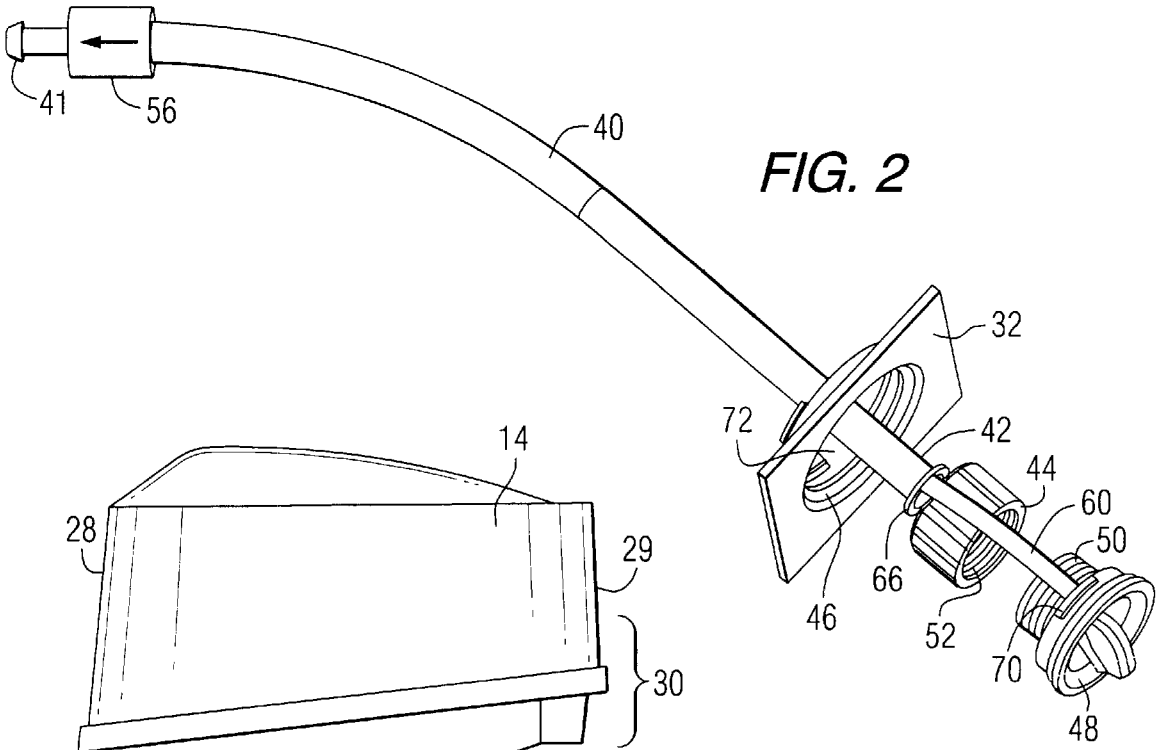
FIG. 2 is an isometric view of the present invention.

Throughout the description of the preferred embodiment of the present invention, like components will be identified by like reference numerals.

Figure is a conventional representation of an exemplary outboard motor 10 of the type that is known to those skilled in the art. The outboard motor 10 comprises an engine disposed under a cowl 14, a driveshaft housing portion 16, and a gearcase portion 18. The gearcase portion 18 houses and supports a propeller shaft connected to a propeller 20. A clamp bracket 24 allows the outboard motor 10 to be rigidly clamped to a transom of a marine vessel. The portion of the outboard motor identified by reference numeral 26 is a lower cowl portion, or support plate, which provides a support structure for the internal combustion engine disposed under the cowl 14. The outboard motor 10 has a rear surface 28 and a front surface 29. Reference numeral 30 identifies a particular region of the front surface at which point the present invention can preferably be located.

Figure 1:
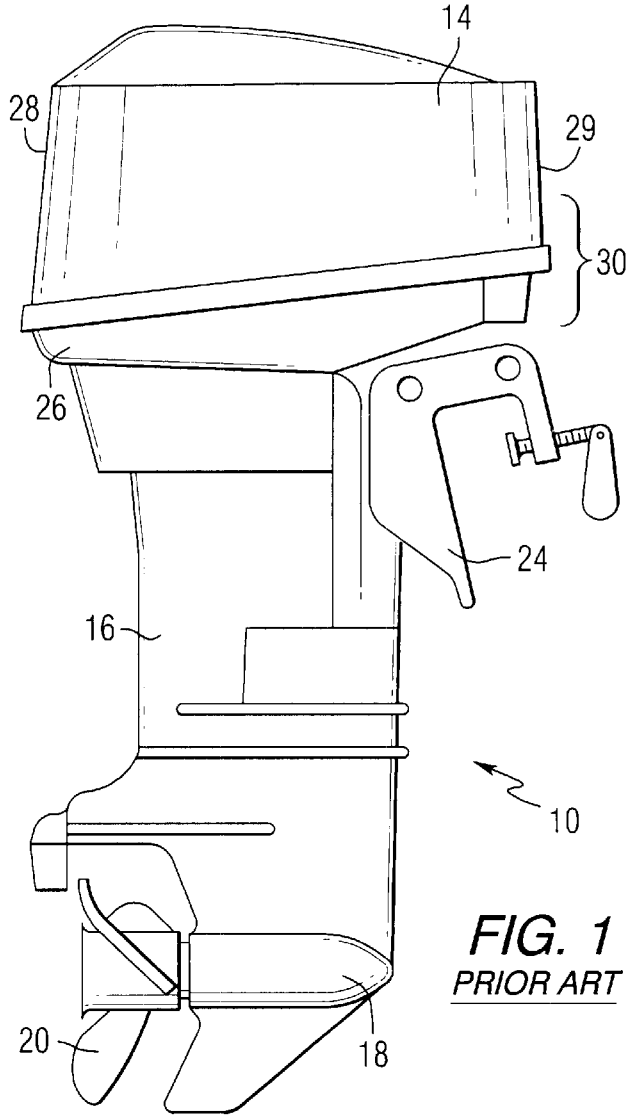
FIG. 1 PRIOR ART
FIG. 1 shows a known outboard motor configuration.

FIG. 2 is an isometric view of a portion of the present invention. A segment 32 of the front surface 29 of the outboard motor 10 in region 30 is illustrated in FIG. 2 to show how the present invention interacts with the surface of the outboard motor 10 shown in FIG. 1. It should be understood that the segment 32 is a partially torn away segment used for purposes of illustration.

With continued reference to FIG. 2, the flushing adaptor for an outboard motor, made in accordance with the preferred embodiment of the present invention, comprises a conduit 40 which has a first end 41 and a second end 42. The first end is intended to be connected in fluid communication with the cooling system of the outboard motor, as will be described below in conjunction with FIG. 3. A hose fitting 44 is attached to the second end 42 of the conduit 40. An opening 46 is formed in the outer surface of the outboard motor 10, which is represented by the segment 32 shown in FIG. 2. A lid 48 is removably attached to the hose fitting 44 and is also shaped to be removably attachable to the opening 46. The external threaded male portion 50 of the lid 48 is attachable in threaded association, with the female threaded portion 52 of the hose fitting 44. This allows the lid 48 to be threaded into the hose fitting 44 in order to be secured when the flushing adaptor of the present invention is not being used to flush the cooling system of the outboard motor. This relationship of the threaded portions, 50 and 52, also serves as a sealing plug that provides redundancy to the check valve 56. A check valve 56 is disposed in fluid communication with the conduit 40 to inhibit flow through the conduit in a direction from the first end 41 toward the second end 42. The arrow on the check valve 56 indicates the allowable direction of flow permitted by the check valve.

With continued reference to FIG. 2, a tether 60 is attached to the lid 48 and to the conduit 40 for maintaining the lid 48 in a region proximate the conduit 40. The tether 60 has a ring portion 66 which is shaped to fit around the conduit 40. The presence of the hose fitting 44 prevents the ring portion 66 from being removed from the conduit 40 and, in turn, the connection of the tether 60 to the lid 48 prevents the lid 48 from being moved away from the second end 42 of the conduit 40. This prevents the lid 48 from being misplaced or lost during the flushing procedure.

The hose fitting 44, in a preferred embodiment of the present invention, is a female hose fitting and the lid 48 is threaded at the male threaded portion 50 for attachment to the hose fitting 44 in threaded association. The lid 48 is provided with two tab extensions 70. In FIG. 2, only one tab extension 70 is visible. The other tab extension extends from the lid 48 in a direction opposite to the tab extension shown and located at a diametrically opposite position on the lid 48. The opening 46 comprises two slots 72. Only one slot 72 is visible in FIG. 2. The other slot is diametrically opposed within the opening 46. The two slots 72 are shaped to receive the two tab extensions 70 when the lid 48 is pushed into the opening 46. The lid 48 is attachable to the opening 46 by rotating the lid 48 when the two extensions 70 are disposed within the two slots 72. With continued reference to FIG. 2, the opening 46 is preferably disposed at a front surface 29 of the outboard motor 10 and, most preferably, in a region identified by reference numeral 30 in FIG. 1.

Figure 3:
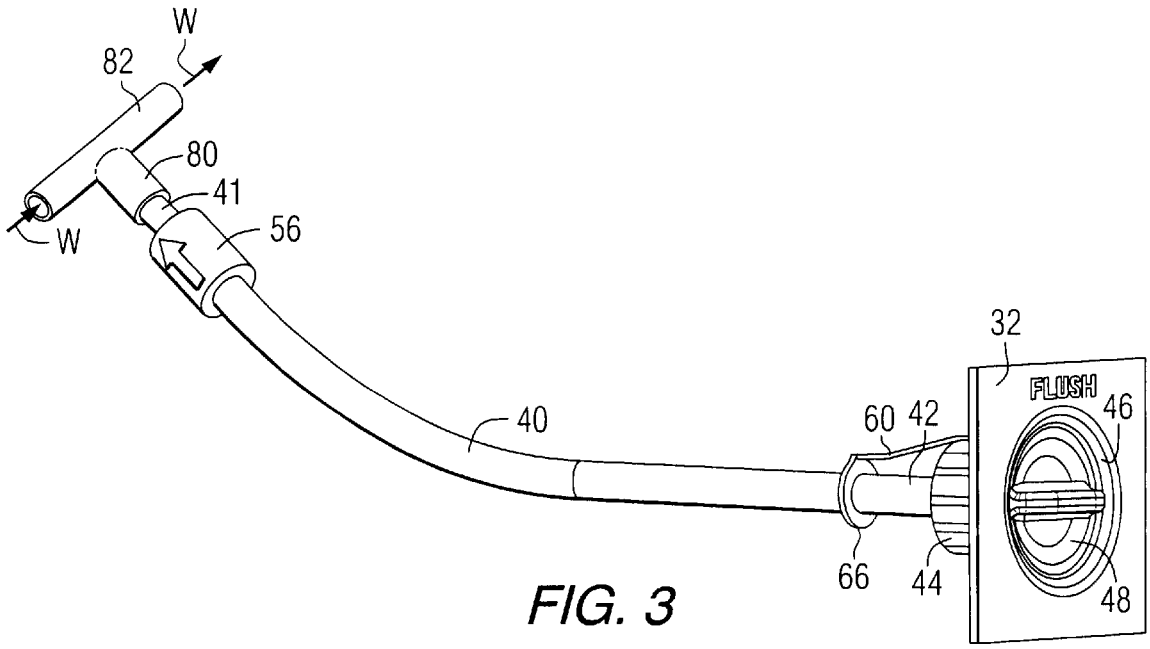
FIG. 3 shows the present invention connected to the cooling system of an outboard motor.

In FIG. 3, the first end 41 of the conduit 40 is shown connected to a T-shaped connection 80 of the cooling system of the outboard motor. Arrows W represent the typical direction of flow of cooling water through the cooling system 82 which is represented in FIG. 3 by a short segment of a cooling system conduit. In FIG. 3, the hose fitting 44 is disposed inside the front surface of the outboard motor, represented by segment 32, and the lid 48 is firmly attached to the opening 46 by aligning the tab extensions 70 with the slots 72, inserting the lid 48 into the opening 46, and then rotating the lid 48 to lock the lid to the opening 46 through misalignment of the tab extension 70 with the slots 72. The tether 60 is shown extending from the lid 48 into the internal portion of the outboard motor and connected to the ring 66 which remains in place surrounding the outer surface of the conduit 40.

Figure 4:
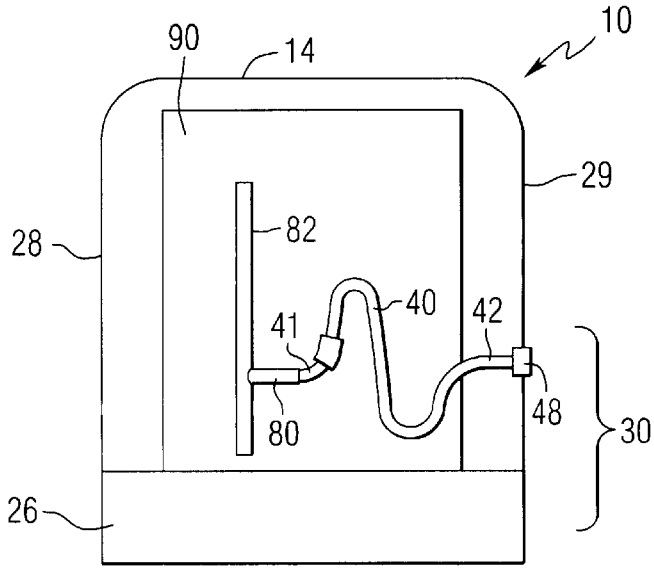
FIG. 4 is a highly schematic representation showing the additional length of a conduit disposed within the volume of a cowl of an outboard motor.

FIG. 4 is a highly schematic representation of the relevant portion of an outboard motor 10 under the cowl 14 which is provided in order to illustrate one particular characteristic of the present invention that provides additional benefits. The conduit 40 is shown with its first end 41 connected to the T-shaped connection 80 of a conduit 82 of the water cooling system of an internal combustion engine 90 which is located under the cowl 14. The front surface 29 of the cowl 14 is identified and the lid 48 is illustrated as being attached to the front surface 29 and within the region identified by reference numeral 30. The lower cowl portion 26 is shown for purposes of illustration.

In FIG. 4, the conduit 40 is clearly illustrated as having a length which is greater than the straight line distance between the lid 48 which is attached to the second end 42 and the point of attachment between the first end 41 and the cooling system of the outboard motor. In other words, the straight line distance from the T-shaped connection 80 to the opening 46 in which the lid 48 is attached is significantly less than the available length of the conduit 40 which is arranged in a curved shape in FIG. 4. As a result of this extra length of the conduit 40, the hose fitting 44, described above in conjunction with FIGS. 2 and 3, can be extended in a direction away from the outboard motor 10 and away from the front surface 29. This extension of the conduit 40 out of the cowl 14 and away from the front surface 29 facilitates its connection to an external water source, such as a garden hose. More particularly, if the conduit 40 is long enough, the hose fitting 44 can be extended around the front surface 29 of the outboard motor 10 to facilitate access to a garden hose at either side of the outboard motor 10. In other words, the connection to the garden hose does not have to be made in the region immediately proximate the front surface 29 of the outboard motor 10. The hose fitting 44 can be extended away from the opening 46 by a significant distance that allows easy connection to external water sources either in front of the outboard motor 10 or at its sides. Therefore, in a particularly preferred embodiment of the present invention, the conduit 40 is shaped to have a length which is greater, by a first magnitude, than the distance between the second end 42, or the opening 46, and the point of attachment between the first end 44 and the cooling system of the engine 90. This first magnitude, in a particularly preferred embodiment, is at least equal to one half of the width of the cowl 14 measured along its front surface 29. Of course, it should be understood, that additional length of the conduit 40 beyond the first magnitude can also be beneficial.

Figure 5:
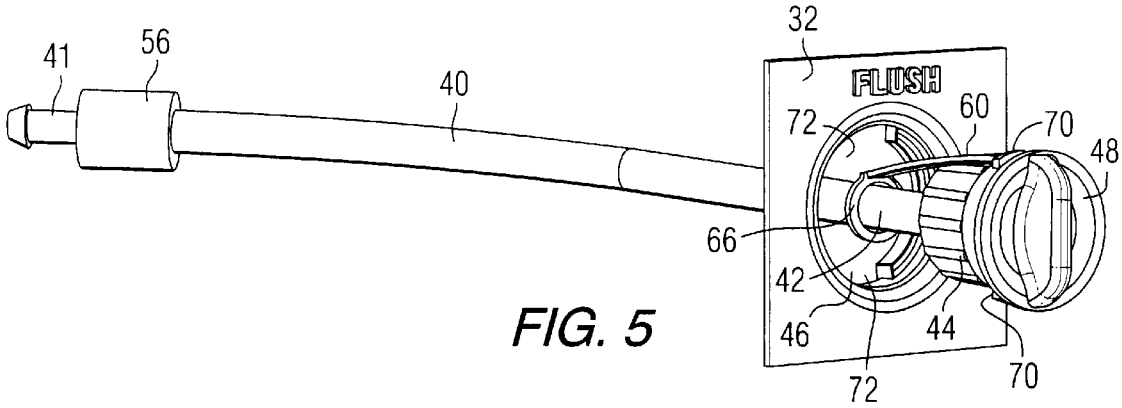
FIG. 5 shows the present invention during preparation for use.

FIG. 5 illustrates the present invention after the lid 48 has been removed from the opening 46, but before the hose fitting 48 has been disconnected from the lid 48. In this arrangement, the conduit 40 can be pulled through the opening 46 to extend the conduit 40 to a convenient location away from the front surface 29, which is represented by segment 32 in FIG. 5. Then, the lid 48 can be unthreaded from the hose fitting 48 to allow the male end of the water source, such as a garden hose, to be attached in fluid communication with the hose fitting 48. When the water hose is turned on, water is allowed to flow through the conduit 48 by the check valve 56 in order to flush the cooling system of the engine with fresh water. When the lid 48 is unthreaded from the hose fitting 44, the tether 60 retains the lid 48 in a convenient position and prevents its being misplaced or lost.

Figure 6:
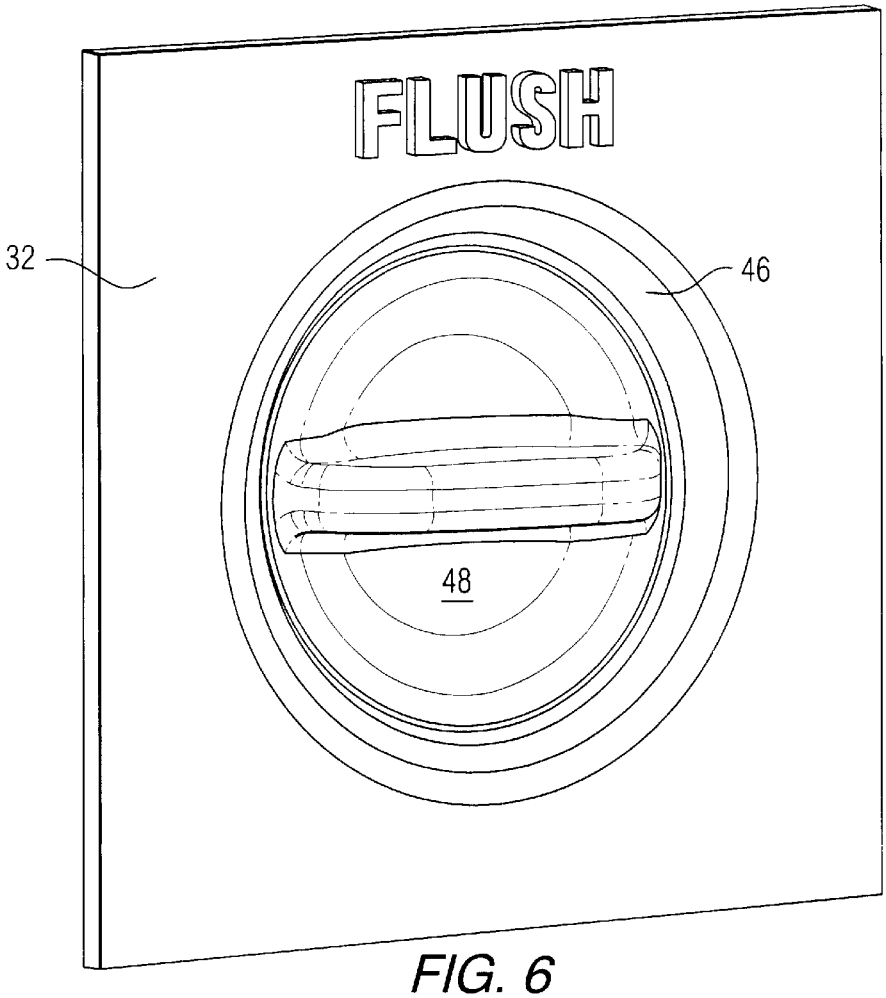
FIG. 6 shows a lid of the present invention attached to an opening formed in the front surface of an outboard motor.

FIG. 6 illustrates the front surface 29 of the outboard motor 10, as represented by segment 32. The lid 48 is rigidly attached to the opening 46. Because of the recessed nature of the opening 46, the attachment of the lid 48 to the opening provides a non obstructive relationship between the lid 48 and the cowl of the outboard motor while also providing convenient access to the lid 48 when the operator of the marine vessel desires to flush the cooling system.

Although the present invention has been described in particular detail and illustrated to show a preferred embodiment, it should be understood that alternative embodiments are also within its scope.

I claim:

1. A flushing adapter for an outboard motor, comprising:

a conduit having a first end and a second end, said first end being connected in fluid communication with a cooling system of said outboard motor;

a hose fitting attached to said second end of said conduit;

an opening formed in an outer surface of said outboard motor;

a lid which is removably attachable to said hose fitting, said lid being shaped to be removably attachable to said opening; and a check valve disposed in fluid communication with said conduit to inhibit fluid flow through said conduit in a direction from said first end toward said second end, said conduit being shaped to have a length which is greater than the distance between said opening and the point of attachment between said first end and said cooling system of said outboard motor.

2. The flushing adapter of claim 1, further comprising:

a tether attached to said lid and to said conduit for maintaining said lid in a region proximate said conduit.

3. The flushing adapter of claim 1, wherein:

said hose fitting is a female hose fitting.

4. The flushing adapter of claim 1, wherein:

said lid is threaded for attachment to said hose fitting in threaded association therewith.

5. The flushing adapter of claim 1, wherein:

said lid comprises two tab extensions and said opening comprises two slots, said two slots being shaped to receive said two tab extensions, said lid being attachable to said opening by rotating said lid when said two tab extensions are disposed in said two slots.

6. The flushing adapter of claim 1, wherein:

said opening is disposed at a front surface of said outboard motor.

7. The flushing adapter of claim 1, wherein:

said conduit is shaped to have a length which is greater, by a first magnitude, than the distance between said opening and the point of attachment between said first end and said cooling system of said outboard motor, said first magnitude being at least equal to one half of the width of a cowl of said outboard motor.

8. A flushing adapter for an outboard motor, comprising:

a conduit having a first end and a second end, said first end being connected in fluid communication with a cooling system of said outboard motor;

a female hose fitting attached to said second end of said conduit;

an opening formed in an outer surface of said outboard motor, said conduit being shaped to have a length which is greater than the distance between said opening and the point of attachment between said first end and said cooling system of said outboard motor;

a lid which is removably attachable to said hose fitting, said lid being shaped to be removably attachable to said opening; and a check valve disposed in fluid communication with said conduit to inhibit fluid flow through said conduit in a direction from said first end toward said second end.

9. The flushing adapter of claim 8, wherein:

said lid is threaded for attachment to said hose fitting in threaded association therewith.

10. The flushing adapter of claim 8, further comprising:

a tether attached to said lid and to said conduit for maintaining said lid in a region proximate said conduit.

11. The flushing adapter of claim 8, wherein:

said lid comprises two tab extensions and said opening comprises two slots, said two slots being shaped to receive said two tab extensions, said lid being attachable to said opening by rotating said lid when said two tab extensions are disposed in said two slots.

12. The flushing adapter of claim 8, wherein:

said opening is disposed at a front surface of said outboard motor.

13. The flushing adapter of claim 8, wherein:

said conduit is shaped to have a length which is greater, by a first magnitude, than the distance between said opening and the point of attachment between said first end and said cooling system of said outboard motor, said first magnitude being at least equal to one half of the width of a cowl of said outboard motor.

14. A flushing adapter for an outboard motor, comprising:

a conduit having a first end and a second end, said first end being connected in fluid communication with a cooling system of said outboard motor;

a hose fitting attached to said second end of said conduit;

an opening formed in an outer surface of said outboard motor;

a lid which is removably attachable to said hose fitting, said lid being shaped to be removably attachable to said opening, said lid comprising two tab extensions and said opening comprises two slots, said two slots being shaped to receive said two tab extensions, said lid being attachable to said opening by rotating said lid when said two tab extensions are disposed in said two slots; and a check valve disposed in fluid communication with said conduit to inhibit fluid flow through said conduit in a direction from said first end toward said second end.

15. The flushing adapter of claim 14, wherein:

said conduit is shaped to have a length which is greater than the distance between said opening and the point of attachment between said first end and said cooling system of said outboard motor.

16. The flushing adapter of claim 15, wherein:

said lid is threaded for attachment to said hose fitting in threaded association therewith.

17. The flushing adapter of claim 16, further comprising:

a tether attached to said lid and to said conduit for maintaining said lid in a region proximate said conduit.

18. The flushing adapter of claim 17, wherein:

said opening is disposed at a front surface of said outboard motor.

19. The flushing adapter of claim 18, wherein:

said conduit is shaped to have a length which is greater, by a first magnitude, than the distance between said second end and the point of attachment between said first end and said cooling system of said outboard motor, said first magnitude being at least equal to one half of the width of a cowl of said outboard motor.

* * * * *